US007676873B1

(12) United States Patent
Simms

(10) Patent No.: US 7,676,873 B1
(45) Date of Patent: Mar. 16, 2010

(54) WRENCH AND REAMER TOOL

(76) Inventor: Kenneth W. Simms, 310 Placitas Rd., NW., Albuquerque, NM (US) 87107

( * ) Notice: Subject to any disclaimer, the term of this patent is extended or adjusted under 35 U.S.C. 154(b) by 68 days.

(21) Appl. No.: 11/946,013

(22) Filed: Nov. 27, 2007

(51) Int. Cl.
*B25B 7/22* (2006.01)

(52) U.S. Cl. ..... 7/129; 7/157

(58) Field of Classification Search ..... 7/129, 7/132, 157, 142; 81/405–409, 411, 418–420
See application file for complete search history.

(56) References Cited

U.S. PATENT DOCUMENTS 1,122,165 A * 12/1914 Schoening ..... 81/302
1,902,913 A 3/1933 Sievern
2,196,701 A 4/1940 Homsher
2,526,180 A 10/1950 Le Gros White
2,575,779 A 11/1951 Young
3,760,473 A 9/1973 Studdard
3,921,237 A 11/1975 Steiner
4,104,752 A * 8/1978 Amrein et al. ..... 7/107
5,497,522 A 3/1996 Chen
5,575,029 A 11/1996 Simpson
6,019,020 A * 2/2000 Liou ..... 81/407
6,202,517 B1 * 3/2001 Dolan ..... 81/427
7,182,004 B1 * 2/2007 Wang ..... 81/409.5

* cited by examiner

*Primary Examiner*—D. S Meislin
(74) *Attorney, Agent, or Firm*—Ray R. Regan; Dennis F. Armijo

(57) ABSTRACT

The specification and drawing figures describe and show a wrench and reamer tool that includes two handle plates. On one handle plate a serrated ledge is formed. Beneath the ledge is an arcuate shoulder that forms a seam for positioning the wrench adjacent an opening in a pipe. On the second handle plate a tapered nose is formed with an inclined face to enable insertion into a pipe. A plurality of opposing edges is formed on the handle plates for deburring a pipe.

13 Claims, 8 Drawing Sheets

WRENCH AND REAMER TOOL

FIELD OF TECHNOLOGY

The apparatus and method disclosed and claimed in this document pertain generally to multipurpose hand tools. More particularly, the new and useful wrench and reamer tool disclosed and claimed in this document pertains to an apparatus that may be used at least both to grip a pipe and remove burrs from openings in the pipe. The wrench and reamer tool is particularly, but not exclusively, useful in connection with installation and repair of electrical conduit and plumbing pipes during which the tool can be used to provide a variety of operations using the single tool.

BACKGROUND

Electricians, plumbers, and similar artisans often work in cramped environments where, once positioned, it would be useful to have a tool that can be used to perform a variety of operations that customarily performed using several different tools. Valuable time is lost switching from one tool to another tool or searching for a misplaced tool. In addition, toolboxes and tool belts are awkward appendages in cramped environments, and their weight can strain anatomical features of an artisan to the point of disabling the artisan.

An electrician, for example, often is required to grasp portions of conduit or pipe to cut conduit or pipe with a cutting device such as a saw. After the conduit or pipe is cut, an electrician generally is required to remove burrs from the pipe, particularly burrs adjacent the opening in the pipe that is formed by having cut the pipe. The edges of a pipe near the cut opening in the pipe must be smoothed by reaming to prevent damage to one or more wires inserted through the pipe.

Wrenches currently available in the market are, however, not adapted to ream burrs formed adjacent an opening in the pipe. Accordingly, a need exists in the industry for a new and useful multipurpose hand tool that serves as both a wrench and a reamer.

SUMMARY

The wrench and reamer tool includes two plates, one of which is formed with a ledge. A bowed or arcuate shaped shoulder is formed or mounted beneath a portion of the ledge. The substantially arcuate shoulder defines a seam in the plate that can be positioned against a pipe opening in which burrs have formed after a cutting device has been used to cut a pipe to a desired length or shape. A beam is formed or mounted on the ledge. The beam is formed with serrations used to grip a portion of a pipe. The beam also includes opposing edges to remove burrs from a pipe opening while an artisan rotates and twists the handles of the wrench as the seam is held against the opening in a pipe. A second plate that can be repositioned in relation to the first plate is mountable on the first plate. The second plate is formed with a tapered nose. An inclined face that in part defines the tapered nose. The tapered nose includes a second set of opposing edges formed in the inclined face to remove burrs from the pipe while an artisan rotates and twists the handles of the wrench while the seam is held against the opening in the pipe. A serrated surface is included on the second plate to grip another portion of the pipe. Handles for holding and operating the wrench and reamer tool are formed in the first plate and second plate.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the wrench and reamer tool will become apparent when read in conjunction with the following description, drawing figures, and appended claims.

The foregoing has outlined broadly the more important features of the invention to better understand the detailed description that follows, and to better understand the contributions to the art. The wrench and reamer tool is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based may be used as a basis for designing other structures, methods, and systems. The claims, therefore, include equivalent constructions. Further, the abstract associated with this disclosure is intended neither to define the wrench and reamer tool, which is measured by the claims, nor intended to limit the scope of the claims. The novel features of the wrench and reamer tool are best understood from the accompanying drawing, considered in connection with the accompanying description of the drawing, in which similar reference characters refer to similar parts, and in which:

Figure 1:
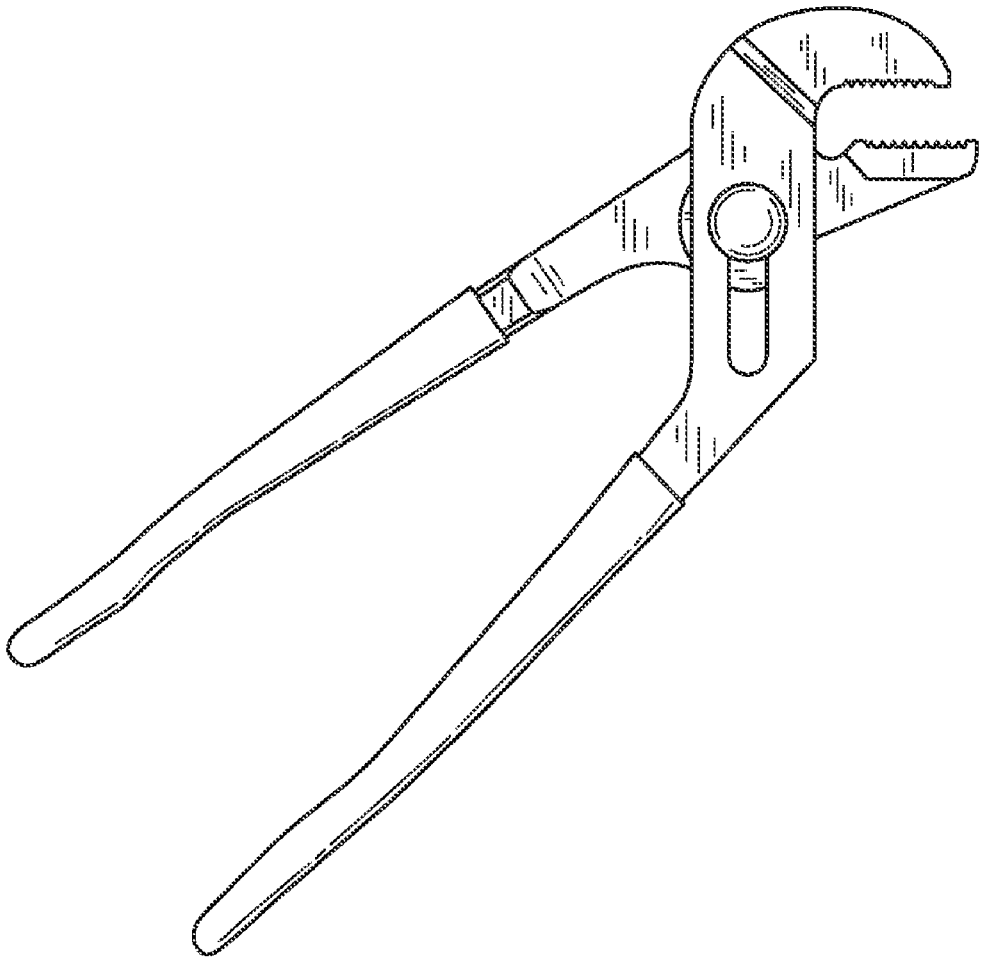
PRIOR ART FIG. 1
FIG. 1 of the drawing is a side perspective view of one example of a conventional box wrench labeled PRIOR ART.

To the extent that the numerical designations in the drawing figures include lower case letters such as "a,b" such designations include multiple references, and the letter "n" in lower case such as "a-n" is intended to express a number of repetitions of the element designated by that numerical reference and subscripts.

DETAILED DESCRIPTION

Definitions

The term "substantially arcuate shoulder" as used in this document means the substantially bow-shaped shoulder 18 illustrated in FIGS. 2A-4B.

The term "burr" or "burrs" means the undesired irregular rough or prickly protrusions or indentations formed by cutting or sawing conduit or pipe.

The term "monolithic" as used in this document includes apparatus components cast as a single piece, as well as those formed without joints or seams as a single unit, and apparatus components formed from parts that are assembled as a single unit, including, as one non-exclusive example, laminar or laminated components assembled into rigid fixed arrangement using rivets, welding, and similar means for assembling the components to operate as a single piece.

DESCRIPTION

As shown in FIGS. 2A-5, a wrench and reamer tool is provided that in its broadest context includes two plates, one of which is formed with a ledge. An arcuate shaped shoulder is shaped or mounted beneath a portion of the ledge. The substantially arcuate shoulder defines a seam that can be positioned against a pipe opening in which burrs have formed after a cutting device has been used to cut the pipe to a desired length or shape. A beam is mounted on the ledge. The beam is formed with serrations to grip a portion of the pipe during operation. The beam also includes a set of opposing edges to remove burrs from the pipe opening. Burrs may be removed from a pipe opening by an artisan who positions the seam defined by the arcuate shoulder and beam against the pipe opening, then rotating and/or twisting the wrench so that the sets of opposing edges described in this document engage, rub over, and smooth the pipe opening to remove burrs. A second plate that can be repositioned in relation to the first plate is mountable on the first plate. The second plate is formed with a tapered nose. An inclined face extending from the trailing end of the tapered nose to the leading edge of the tapered nose defines the tapered nose. The tapered nose includes a second set of opposing edges formed in the inclined face to remove burrs from the pipe. A serrated surface is included on the second plate to grip a second segment of the pipe. Handles for holding and operating the wrench and reamer tool are formed in the first plate and second plate.

More specifically, as shown by cross-reference between FIGS. 2A-5, a wrench and reamer tool 10 includes a first plate 12. The first plate 12 is formed with a ledge 14. As shown perhaps best by cross-reference between FIGS. 2A-2C, the ledge 14 is formed with an angular facet 16. In addition, a substantially arcuate shoulder 18 extends convexly beneath a portion 20 of the ledge 14 of the first plate 12. The substantially arcuate shoulder 18 is configured so as to define a proximal end 22 and a distal end 24. The distal end 24 of the substantially arcuate shoulder 18 defines a seam 26 formed by the intersection between the distal end 24 of the substantially arcuate shoulder 18, and the underside 34 of beam 38 described below and illustrated by cross-reference between FIGS. 2A and 2B.

Figure 4A:
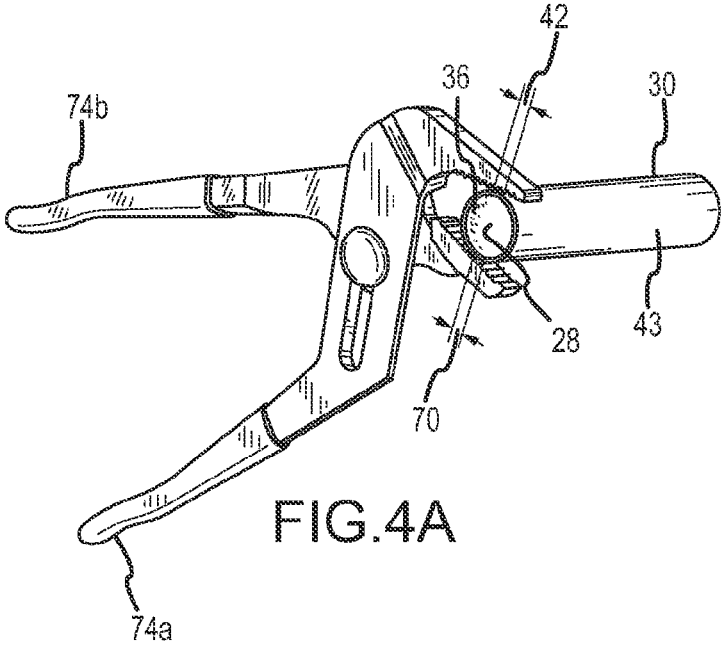
FIG. 4A is a perspective view of the wrench and reamer tool in contact with a segment of a pipe.
Figure 4B:
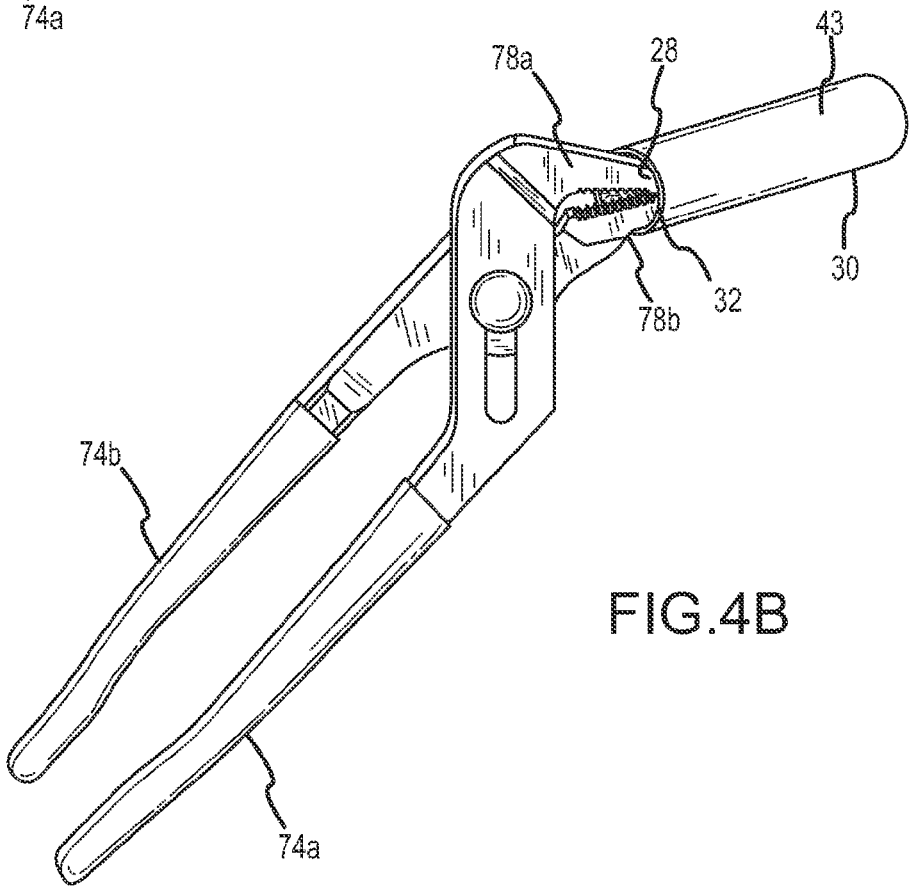
FIG. 4B is a perspective view of the wrench and reamer tool inserted into one opening of another segment of a pipe for removing burrs.

In operation, the seam 26 acts as a stopper for providing leverage to hold the first plate 12 in a desired position when the first plate 12 is inserted into an opening 28 in a pipe 30, as shown best by cross-reference between FIGS. 4A-4B. In addition, seam 26 adds a safety feature to the wrench and reamer tool 10 by preventing the wrench and reamer tool 10 from inadvertently becoming disengaged from opening 28 in a pipe 30 during use and operation, which can cause personal injury to an artisan user. Seam 26 may be positioned adjacent the exposed surface 32 of the opening 28 in the pipe 30, as perhaps best shown in FIG. 4B. As will become more apparent as the unique features of the wrench and reamer tool 10 are described, the handle extensions 74*a,b* of the wrench and reamer tool 10 may be flared or repositioned to maneuver the wrench and reamer tool 10 in a substantially constant plane to affectively remove burrs 36 from the opening 28 in pipe 30.

As illustrated in FIG. 1, showing an example of prior art, a conventional wrench is unable to achieve the foregoing advances in the art made by the wrench and reamer tool 10. The conventional wrench illustrated in FIG. 1 includes a bulbous nose that precludes insertion into the opening of commonly used conduit dimensions. The conventional wrench illustrated in FIG. 1 also lacks the substantially arcuate shoulder 18 of the present wrench and reamer tool 10 that extends convexly beneath a portion 20 of the ledge 14 of the first plate 12. Accordingly, a conventional wrench does not provide a seam 26 formed by the intersection between the distal end 24 of the substantially arcuate shoulder 18, and the underside 34 of beam 38, illustrated by cross-reference between FIGS. 2A and 2B, and therefore the conventional wrench, unlike the present wrench and reamer tool 10, cannot be used successfully to remove burrs 36 from an opening 28 in a pipe 30.

Figure 2A:
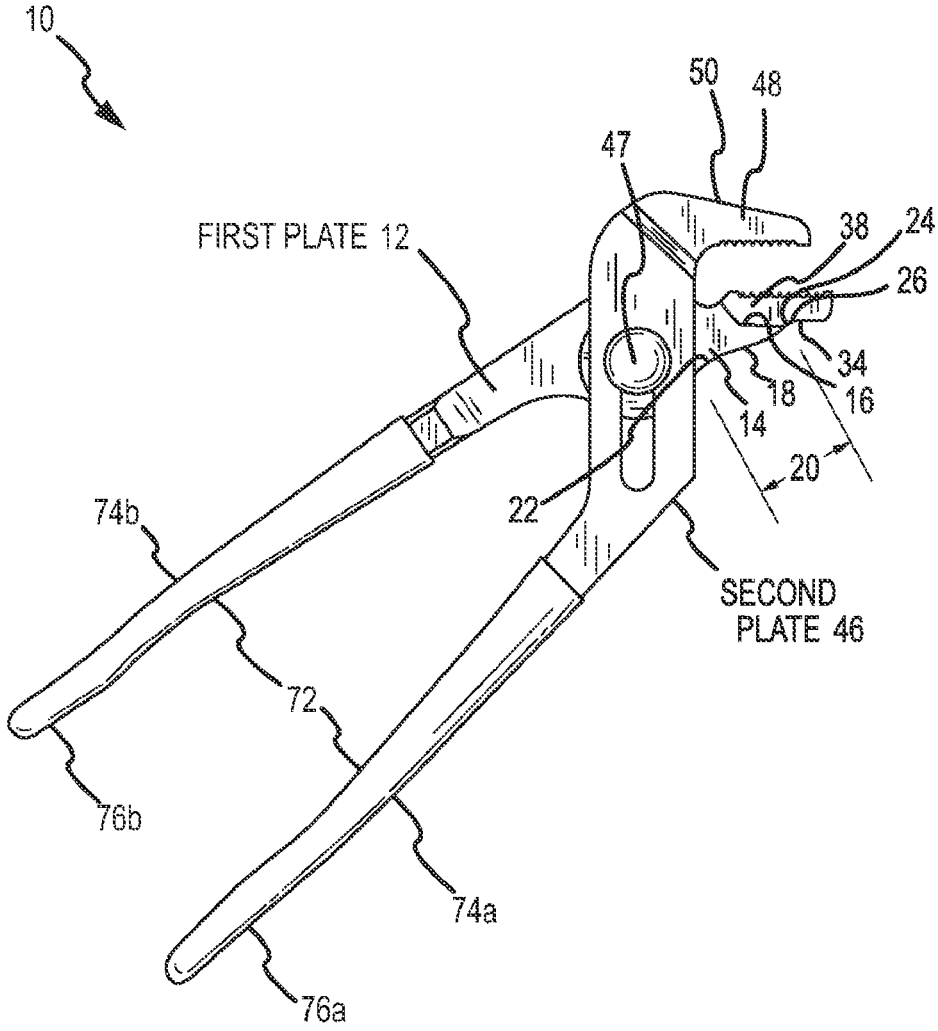
FIG. 2A is a side perspective drawing of the present wrench and reamer tool.
Figure 2B:
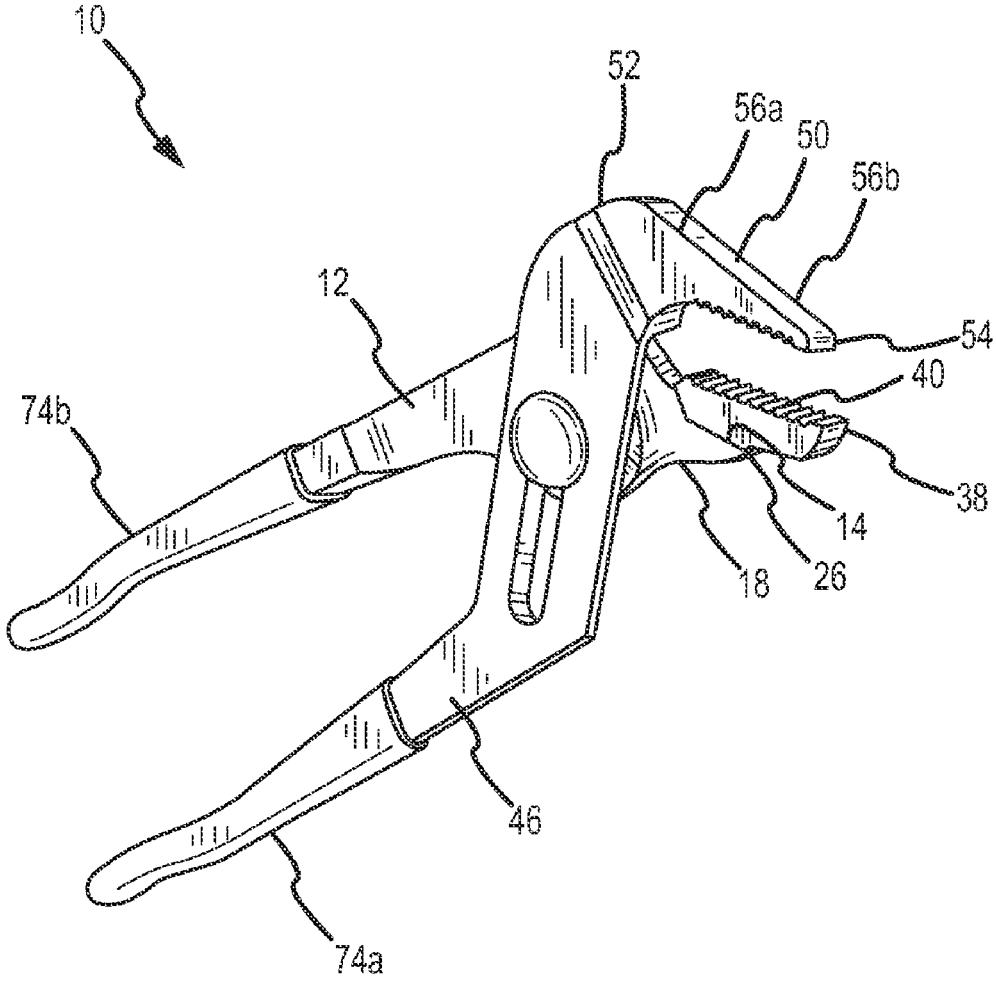
FIG. 2B is perspective view of the wrench and reamer tool with open jaws.

In the embodiments illustrated by cross-reference between FIGS. 2A-2B, as indicated above, the wrench and reamer tool 10 also includes a beam 38. The beam 38 is formed with serrations 40. As shown, the serrations 40 are monolithically formed in the beam 38. The beam 38 is monolithically mounted on the ledge 14. The serrations 40 are provided to grip a first segment 42 of the pipe 30, as perhaps best shown in FIG. 4A. The beam 38 also is formed with a first set of opposing edges 44*a,b*. The first set of opposing edges 44*a,b* is provided to remove burrs 36 from the opening 28 in the pipe 30 or in the pipe 30 in general.

In the embodiments illustrated in FIGS. 2A-2C and 3A, the wrench and reamer tool 10 includes a second plate 46. The second plate 46 is slidably and repositionably mountable on the first plate 12 using methods and apparatus well known to those skilled in the art. For example, as shown in FIG. 1, the first plate 12 and second plate 46 are slidably and repositionably mountable in relationship to each other using a pin 47.

As also illustrated in the embodiments shown in at least FIGS. 2A-2C and 3A, the second plate 46 is formed with tapered nose 48. The tapered nose 48 is defined in part by an inclined face 50. The inclined face 50 extends from the trailing end 52 of the tapered nose 48 to the leading end 54 of the tapered nose 48. The tapered nose 48 is provided to enable the artisan to removably and rotatably insert the wrench and reamer tool 10 into the pipe 30 to remove burrs 36 as described and explained in this document. Thus, to assist in removing burrs 36 from the pipe 30, a second set of opposing edges 56*a,b* is formed in the inclined face 50. Neither the first set of opposing edges 44*a,b* nor the second set of opposing edges 56*a,b* is beveled.

Figure 3A:
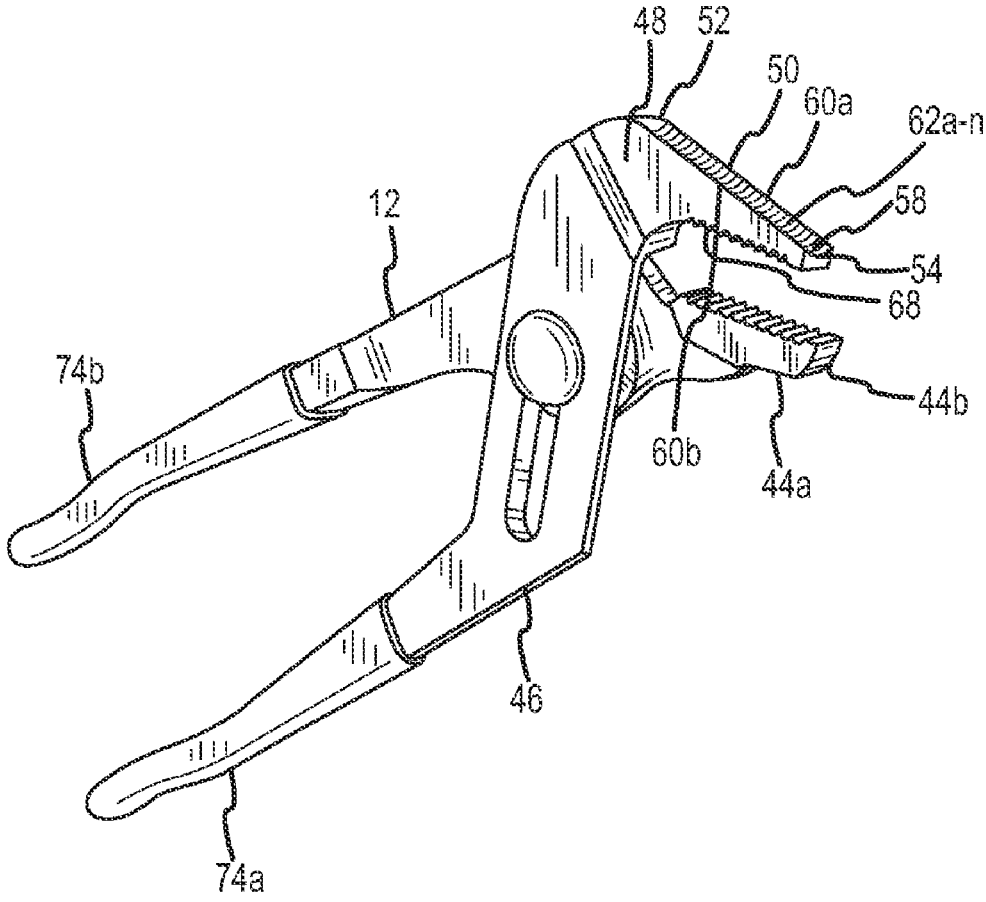
FIG. 3A is a perspective of the wrench and reamer tool having a concave channel formed on the inclined face of the second plate.

In the embodiment illustrated in FIG. 3A, the inclined face 50 of the tapered nose 48 is further configured and shaped to include a first channel 58. The first channel 58 extends from the trailing end 52 of the tapered nose 48 to the leading end 54 of the tapered nose 48. The first channel 58 is provided to increase the capabilities of the wrench and reamer tool 10 to remove burrs 36 by providing at least two sharp rims 60*a,b* that result from excising the first channel 58 in the inclined face 50 of the tapered nose 48. As also illustrated in FIG. 3A, the first channel 58 may include one or more corrugations 62*a-n*. As shown, the one or more corrugations 62*a-n* are formed substantially at right angles to the longitudinal axis of the inclined face 50, and extend from the trailing end 52 of the tapered nose 48 to the leading end 54 of the tapered nose 48. The corrugations 62*a-n* are provided to increase the capabilities of the wrench and reamer tool 10 to remove burrs 36 from the pipe 30. Specifically, the corrugations 62*a-n* assist in scooping burrs 36 away from the pipe 30.

Figure 3B:
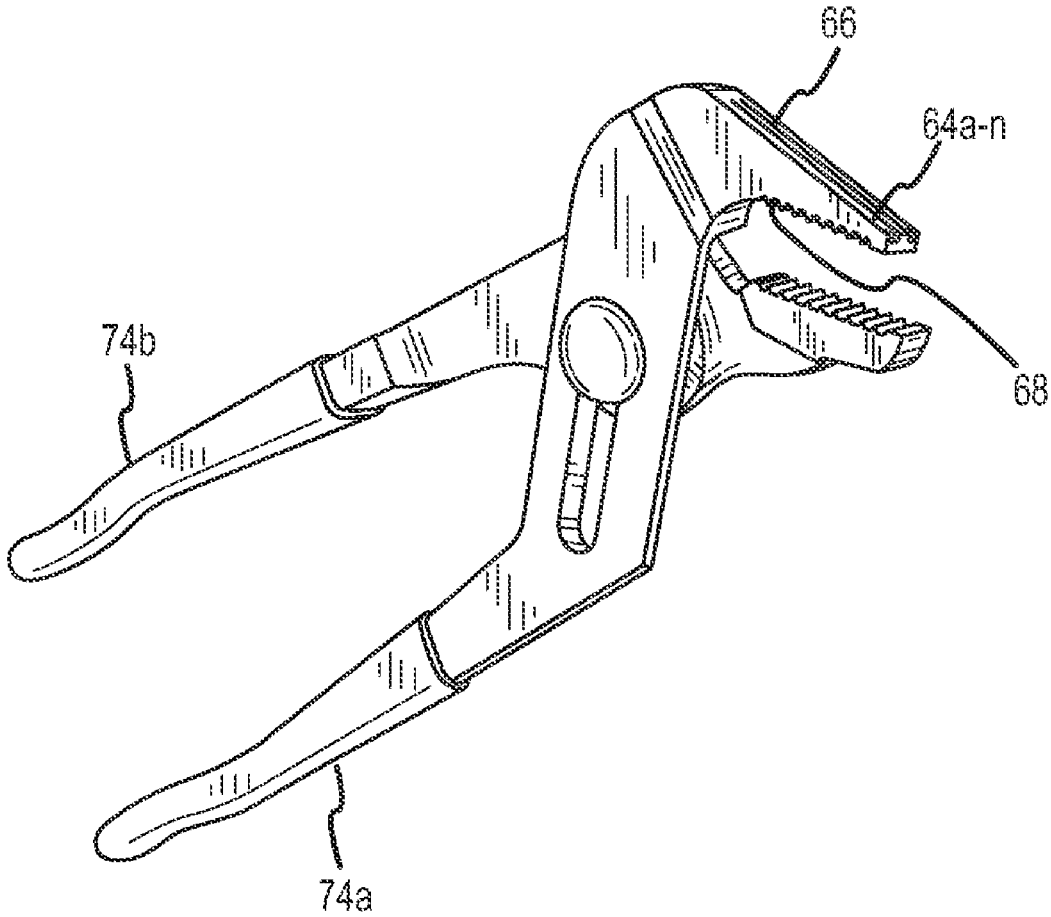
FIG. 3B is a perspective view of the wrench and reamer tool formed with one or more grooves on the inclined face of the second plate of the wrench and reamer tool defining at least one ridge.

In the embodiment illustrated in FIG. 3B, the inclined face 50 of the tapered nose 48 is formed with a series of grooves 64*a-n*. The series of grooves 64*a-n* defines at least one longitudinal ridge 66 adjacent the series of grooves 64*a-n*. The at least one longitudinal ridge 66 is provided to assist in removing burrs 36 from the pipe 30.

Figure 2C:
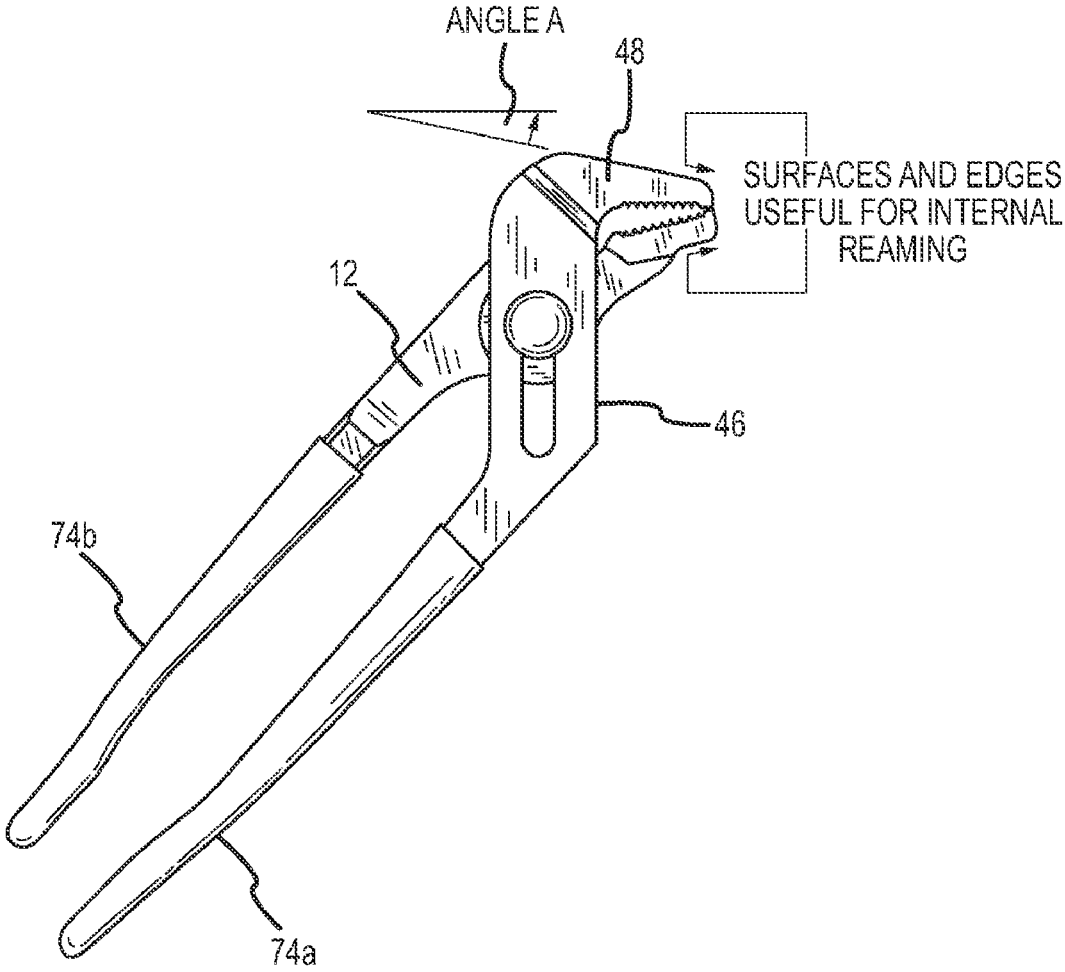
FIG. 2C is a side perspective view of the wrench and reamer tool with closed jaws.

Referring now to FIG. 2C, the inclined face 50 of the tapered nose 48 forms an angle from a line substantially tangent to the trailing end 52 of the tapered nose 48. The angle, denominated Angle A in FIG. 2C, varies between 8 degrees and 12 degrees from the line substantially tangent to the trailing end 52 of the tapered nose 48. In the embodiment illustrated, Angle A is substantially 10 degrees.

As also shown in FIGS. 3A-3B, the second plate 46 includes a serrated surface 68 monolithically formed in the second plate 46 to assist in gripping a second segment 70 of the pipe 30, as perhaps best shown in FIG. 4A. As will be evident to a person skilled in the art, none of the components or features of the wrench and reamer tool 10 is designed to hammer an object.

Means 72, as illustrated in FIG. 2A, are provided for holding and operating the wrench and reamer tool 10. In the embodiment illustrated by cross-reference between FIGS. 3A-4B, the means 72 for holding and operating the wrench and reamer tool 10 are handle extensions 74*a,b* formed respectively in the first plate 12 and in the second plate 46. As a person skilled in the art will recognize, the handle extensions 74*a,b* may include a sleeve 76*a,b* made of a material such as rubber surroundingly mountable on the handle extensions 74*a,b* to enhance the ability of an artisan to use the wrench and reamer tool 10 in operation. As shown, the handle extensions 74*a,b*, in operation, may be oscillated rather than twisted in pendulum fashion in a first plane to remove burrs 36 from the pipe 30. When inserted into a pipe 30, the first set of opposing edges 44*a,b* and the second set of opposing edges 56*a,b* may be rotated in a second plane substantially perpendicular to the first plane to remove burrs 36 from the pipe 30.

In operation, as perhaps best shown by cross-reference between FIGS. 4A-4B, the jaws 78*a,b* of the first plate 12 and of the second plate 46 are insertable into the opening 28 formed in an end 80 of the pipe 30. As indicated, the seam 26 formed by the substantially arcuate shoulder 18 beneath a portion 20 of the ledge 14 can act as a stopper when lodged against the rim 32 of the opening 28 in the pipe 30. By preventing the wrench and reamer tool 10 from inadvertently becoming disengaged from opening 28 in a pipe 30 during use and operation, personal injury to the artisan user is avoided, and any consequent liability avoided for personal injury. The taper of the tapered nose 48, as defined in part by the inclined face 50 on the tapered nose 48, is shaped to permit insertion of the tapered nose 48 into the opening 28 of the pipe 30. As is well known by those skilled in the art, conventional wrenches, as shown in FIG. 1, include neither a tapered nose 48 sized and configured for insertion into an opening 28 in a pipe 30, nor apparatus positioned, sized and shaped such as opposing edges 44*a,b* and 56*a,b* to remove burrs 36 from a pipe 30. By oscillating in pendulum manner the handle extensions 74*a,b* of the wrench and reamer tool 10, the first set of opposing edges 44*a,b* on the beam 38, alone or in combination with the second set of opposing edges 56*a,b* formed in the inclined face 50 of the tapered nose 48 of the second plate 46, quickly and efficiently remove burrs 36 from the pipe 30 using a single multipurpose tool.

As will also be evident to one skilled in the art, in operation a single diameter of the opening 28 in a pipe 30 is not a limitation of the wrench and reamer tool 10. Rather than have to carry an assortment of varying sizes of wrench and reamer tool 10, a single wrench and reamer tool 10 may be used in connection with removing burrs 36 from an opening 18 in a pipe 30. In addition, there is no limitation to the size of an opening 18 that may be reamed. The size of an opening 18 that may be reamed is a function only of the dimensions of the wrench and reamer tool 10.

A number of features of the wrench and reamer tool 10 contribute to those technical advantages, including at least (a) the configuration of the first plate 12 and the second plate 46, (b) the configuration of jaws 78*a,b* that allow insertion of jaws 78*a,b* into opening 28 of pipe 30, (c) the seam 26 that may be used as a stopper against exposed surface 32 of opening 28 to position the wrench and reamer tool 10 inside and against opening 28 during operation of the wrench and reamer tool 10, and (d) the ability to adjust the flare or spacing between handle extensions 74*a,b* during oscillation and/or rotation of the wrench and reamer tool 10 following insertion of jaws 78*a,b* into opening 28 of pipe 30 while holding seam 26 against exposed surface 32 of opening 28.

Figure 5:
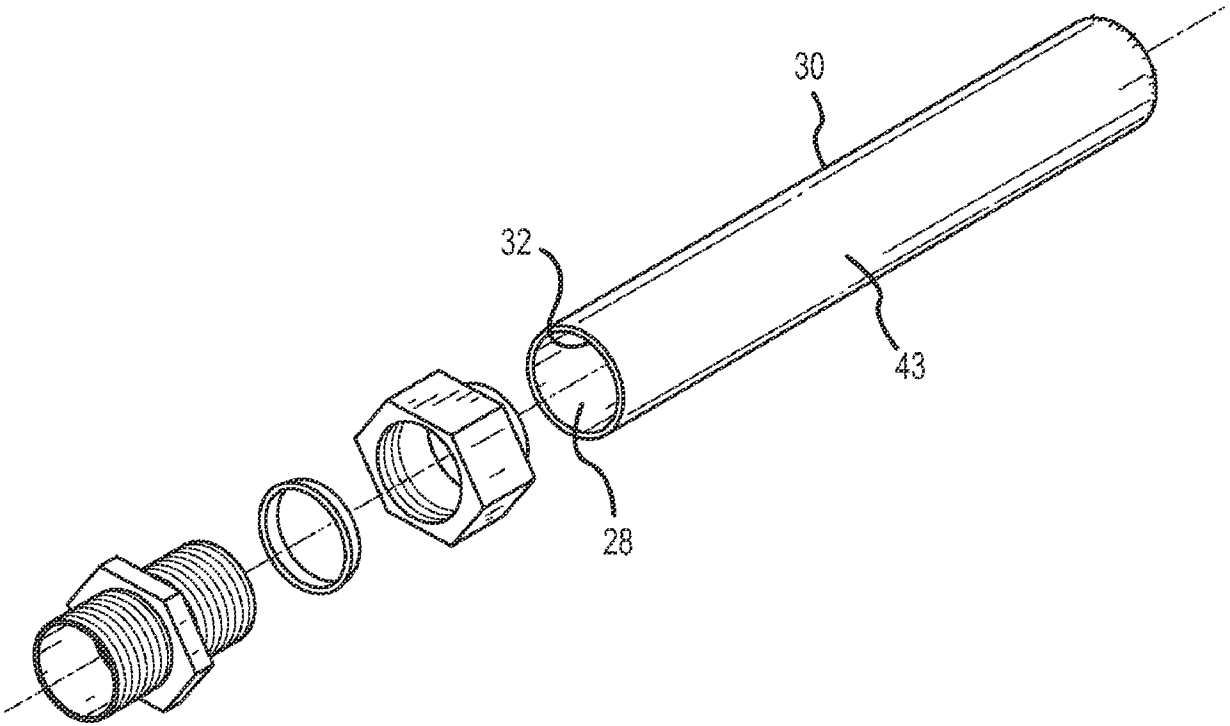
FIG. 5 is a perspective view of a section of conduit and fittings that can be assembled using the same wrench and reamer tool disclosed, illustrated and claimed in this document.

Following the reaming operation using wrench and reamer tool 10, as illustrated in FIG. 5, another technical advantage of wrench and reamer tool 10 will be evident to one skilled in the art: the same wrench and reamer tool 10 can be used to connect fittings to a section of pipe 30, again obviating the need for any tool other than the same wrench and reamer tool 10 disclosed, illustrated and claimed in this document.

Claim elements and steps in this document have been numbered solely as an aid in understanding the description. The numbering is not intended to, and should not be considered as intending to, indicate the ordering of elements and steps in the claims. In addition, the wrench and reamer tool 10 shown in drawing FIGS. 2A through 5 shows at least one embodiment that is not intended to be exclusive, but merely illustrative of the disclosed embodiments.

Means-plus-function clauses in the claims are intended to cover the structures described as performing the recited function that include not only structural equivalents, but also equivalent structures.

What is claimed is:

1. A wrench and reamer tool, comprising:

a first plate formed with a ledge;

a substantially arcuate shoulder extending convexly beneath a portion of the ledge, wherein a distal end of the substantially arcuate shoulder defines a seam adapted to be removably and rotatably insertable adjacent a pipe opening;

a beam formed with serrations monolithically mounted on the ledge adapted to grip a first segment of the pipe, wherein the beam formed with serrations further comprises a first set of opposing edges adapted to remove burrs from the pipe opening;

a second plate slidably and repositionably mountable on the first plate, wherein the second plate is formed with a tapered nose defined by an inclined face extending from the trailing end of the tapered nose to the leading edge of the tapered nose, adapted to be removably and rotatably insertable into the pipe opening, wherein the inclined face of the tapered nose further comprises a channel formed with one or more corrugations at substantially right angles to the longitudinal axis of the inclined face extending from the trailing end of the tapered nose to the leading edge of the tapered nose adapted to increase the capabilities of the tool to remove burrs;

a second set of opposing edges formed in the inclined face adapted to remove burrs from the pipe opening;

a serrated surface monolithically formed in the second plate adapted to grip a second segment of the pipe; and means for holding and operating the wrench and reamer tool.

2. A wrench and reamer tool as recited in claim 1, wherein the means for holding and operating the wrench and reamer tool include handles monolithically extending from the first plate and second plate.

3. A wrench and reamer tool as recited in claim 2, wherein the handles in operation may be oscillated rather than twisted in pendulum fashion in a first plane to remove burrs from the pipe opening.

4. A wrench and reamer tool as recited in claim 3, wherein the handles in operation cause the first set of opposing edges and the second set of opposing edges to rotate in a second plane substantially perpendicular to the first plane to remove burrs from the pipe opening.

5. A wrench and reamer tool as recited in claim 1, wherein the first set of opposing edges and the second set of opposing edges are not beveled.

6. A wrench and reamer tool as recited in claim 1, wherein the inclined face of the tapered nose further comprises a first channel extending from the trailing end of the tapered nose to the leading edge of the tapered nose adapted to increase the capabilities of the tool to remove burrs.

7. A wrench and reamer tool as recited in claim 1, wherein the inclined face of the tapered nose further comprises a series of grooves extending from the trailing end of the tapered nose to the leading edge of the tapered nose adapted to define at least one longitudinal ridge to remove burrs from the pipe opening.

8. A wrench and reamer tool as recited in claim 1, wherein the inclined face of the tapered nose forms an angle from a line tangent to the trailing end of the tapered nose ranging between 8 degrees and 12 degrees.

9. A multipurpose hand tool, comprising:

a wrench formed with opposable serrated surfaces for gripping curved portions of a pipe;

means monolithically formed on the wrench for removably and rotatably positioning the wrench within an opening formed in the pipe, further comprising a substantially bow-shaped shoulder formed in the wrench that defines a seam positionable adjacent a rim in an opening formed in the pipe, a linear inclined face formed on one end of one of the two adjustable handle plates, wherein the linear inclined face further comprises a channel with two cutting edges extending from the trailing end of the tapered nose to the leading edge of the tapered nose for removing burrs from the pipe, wherein the channel comprises one or more corrugations at substantially right angles to the longitudinal axis of the linear inclined face adapted to more precisely define the plurality of opposing edges of the inclined face to remove burrs from the opening in the pipe;

the two cutting edges monolithically formed on the wrench for deburring the opening formed in the pipe; and two adjustable handle plates for gripping the wrench and deburring the opening in the pipe.

10. A multipurpose hand tool as recited in claim 9, wherein the one or more corrugations comprises a series of grooves and ridges adapted to remove burrs from the opening in the pipe.

11. A method for using a wrench and reamer on a pipe, comprising the steps of:

forming a first plate having a ledge;

mounting on the first plate a substantially arcuate shoulder extending convexly beneath a portion of the ledge, wherein a distal end of the substantially arcuate shoulder defines a seam adapted to be removably and rotatably insertable adjacent a pipe opening;

installing a serrated beam monolithically mounted on the ledge adapted to grip a first segment of the pipe;

disposing a first set of opposing edges on the serrated beam adapted to deburr a pipe opening;

providing a second plate slidably and repositionably mountable on the first plate;

shaping one end of the second plate to form a tapered nose defined by an inclined face extending from a trailing end of the tapered nose to a leading edge of the tapered nose adapted to be removably and rotatably insertable into the pipe opening, wherein the inclined face further comprises a channel formed with one or more corrugations at substantially right angles to the longitudinal axis of the inclined face extending from the trailing end of the tapered nose to the leading edge of the tapered nose adapted to increase the capabilities of the tool to remove burrs;

disposing a second set of opposing edges on the linearly inclined face adapted to remove burrs from the-pipe opening;

installing a serrated surface monolithically formed on the second plate adapted to grip a second section of the pipe; and configuring the first plate and the second plate for holding and operating the wrench reamer tool.

12. A method for using a wrench and reamer on a pipe as recited in claim 11, wherein the step of providing a second plate slidably and repositionably mountable on the first plate to form a wrench in combination with the first plate includes the substep of forming a tapered nose on the second plate defined by the linearly inclined face extending from the trailing end of the tapered nose to the leading edge of the tapered nose.

13. A method for using a wrench and reamer on a pipe as recited in claim 11, wherein the step of shaping one end of the second plate to form a tapered nose adapted to be removably and rotatably insertable into the pipe opening includes the substep of shaping the tapered nose to include at least one longitudinal ridge adapted to remove burrs from the pipe opening.

* * * * *